United States Patent [19]

Pivitt et al.

[11] Patent Number: 4,911,061

[45] Date of Patent: Mar. 27, 1990

[54] COMPOSITE CERAMIC ARMOR AND METHOD FOR MAKING SAME

[75] Inventors: Allen F. Pivitt, Troy; David K. Rock, Romeo; Needangalam S. Sridharan, Ortonville, all of

[73] Assignee: General Dynamics Land Systems, Inc., Troy, Mich.

[21] Appl. No.: 326,973

[22] Filed: Mar. 22, 1989

[51] Int. Cl.[4] ..... F41H 5/02; F41H 5/16

[52] U.S. Cl. ..... 89/36.02; 109/84; 428/911

[58] Field of Search ..... 89/36.02; 428/911, 49; 109/84, 80; 52/630

[56] References Cited

U.S. PATENT DOCUMENTS

| | | | |
|---|---|---|---|
| 3,232,017 | 2/1966 | Prusinski et al. | 89/36.02 |
| 3,324,768 | 6/1967 | Eichelberger | 89/36.02 |
| 3,431,818 | 3/1969 | King | 89/36.02 |
| 3,444,033 | 5/1969 | King | 428/911 |
| 3,454,947 | 7/1969 | Wesch et al. | 89/36.02 |
| 3,509,833 | 5/1970 | Cook | 428/911 |
| 3,516,898 | 6/1970 | Cook | 428/911 |
| 3,616,115 | 10/1971 | Klimmek | 52/630 |
| 3,700,534 | 10/1972 | Cook | 89/36.02 |
| 3,702,593 | 11/1972 | Fine | 109/80 |
| 3,705,558 | 12/1972 | McDougal et al. | 109/84 |
| 3,722,355 | 3/1973 | King | 89/36.02 |
| 3,736,838 | 6/1973 | Butterweck et al. | 89/36.02 |
| 3,801,416 | 4/1974 | Gulbierz | 428/911 |
| 3,859,892 | 1/1975 | Coes | 89/36.02 |
| 3,924,038 | 12/1975 | McArdle et al. | 89/36.02 |
| 4,049,864 | 9/1977 | Hoover et al. | 428/911 |
| 4,179,979 | 12/1979 | Cook et al. | 89/36.02 |
| 4,292,882 | 10/1981 | Clausen | 89/36.02 |
| 4,526,828 | 7/1985 | Fogt et al. | 428/911 |
| 4,660,223 | 4/1987 | Fritch | 428/911 |
| 4,665,794 | 5/1987 | Gerber et al. | 89/36.02 |
| 4,732,803 | 3/1988 | Smith | 89/36.02 |

*Primary Examiner*—David H. Brown

*Attorney, Agent, or Firm*—Brooks & Kushman

[57] ABSTRACT

Composite ceramic armor (10) and a method for making the armor are disclosed as incorporating a plurality of plate-shaped ceramic tiles (12) and cloth (18) wrapped around each tile over each surface (14) and side (16) thereof with a synthetic resin matrix (20) permeating the cloth to encapsulate the tiles such that the resin matrix defines oppositely facing surfaces (22) and a plurality of sides (24) from which the ceramic tiles are spaced by the cloth. The tiles (12) are preferably rectangular and the cloth (18) preferably includes a pair of strips (26,28) wrapped around each tile in perpendicular directions to each other. Woven cloth is preferably utilized and is most preferably made from glass fibers or polyamide plastic fibers such as Kevlar.

11 Claims, 2 Drawing Sheets

COMPOSITE CERAMIC ARMOR AND METHOD FOR MAKING SAME

TECHNICAL FIELD

This invention relates to composite ceramic armor and to a method for making the armor.

BACKGROUND ART

Prior art armor has utilized plate-like ceramic tiles embedded in a matrix to provide protection against incoming projectiles. See, for example, U.S. Pat. Nos. 3,324,768 Eichelberger; 3,431,818 King; 3,444,033 King; 3,509,833 Cook; 3,516,898 Cook; 3,616,115 Klimmek; 3,700,534 Cook; 3,801,416 Gulbierz; and 3,924,038 McArdle et al. Such ceramic armor in the past has been relatively expensive to manufacture due to the difficulty and resultant cost involved in embedding the ceramic tiles within the matrix spaced from each other so as to avoid shock propagation from one tile to the next when subjected to a projectile impacting the armor.

Other prior art armor noted by the investigation conducted in connection with the present invention is disclosed by U.S. Pat. Nos.: 3,454,947 Wesch et al; 3,705,558 McDougal et al; 3,722,355 King; 3,702,593 Fine; 3,859,892 Coes; 4,179,979 Cook et al; and 4,665,794 Gerber et al.

Other non-armor prior art noted during the investigation conducted in connection with the present invention includes U.S. Pat. Nos. 3,232,017 Prusinski et al and 4,049,864 Hoover et al.

DISCLOSURE OF INVENTION

An object of the present invention is to provide improved composite ceramic armor and a method for making the armor so as to provide relatively lightweight protection chat is economical to manufacture and capable of being utilized to fabricate larger surfaces as well as being easily repairable.

In carrying out the above and other objects of the invention, composite ceramic armor constructed in accordance with the present invention includes a plurality of plate-shaped ceramic tiles each of which has oppositely facing surfaces and a plurality of sides. Cloth is wrapped around each tile over each surface and side thereof in the fabrication of the armor. A synthetic resin matrix permeates the cloth to encapsulate the tiles. This resin matrix defines oppositely facing surfaces and a plurality of side with the wrapped cloth spacing the tiles from each other and from the surfaces and sides of the resin matrix.

In its preferred construction, the tiles are rectangular and the cloth includes a pair of strips wrapped around each tile in perpendicular directions to each other. As disclosed, the rectangular tiles are square.

In the preferred construction, the cloth utilized is woven and is most preferably made from glass fibers or polyamide plastic fibers such as Kevlar.

A method for making composite ceramic armor in accordance with the present invention comprises wrapping late-shaped ceramic tiles, each of which has oppositely facing surfaces and a plurality of sides, with cloth that extends over each surface and side of each tile. The wrapped tiles are then placed in a mold cavity with the wrapped cloth spacing the tiles from each and from a mold wall defining the cavity. A synthetic resin is then introduced into the mold cavity to permeate the cloth and provide a matrix that encapsulates the tiles and defines oppositely facing surfaces and sides from which the tiles are spaced by the wrapped cloth.

In the preferred practice of the method, rectangular tiles are utilized and each is wrapped by cloth including two strips that extend perpendicular to each other around the tile. The rectangular tiles are disclosed as being square.

Woven cloth is most preferably utilized to wrap the tiles and is advantageously made from woven glass fibers or woven polyamide plastic fibers such as Kevlar fibers.

The objects, features and advantages of the present invention are readily apaarent from the following detailed description of the best mode for carrying out the invention when taken in connection with the accompanying drawings.

BEST MODE FOR CARRYING OUT THE INVENTION

Figure 1:
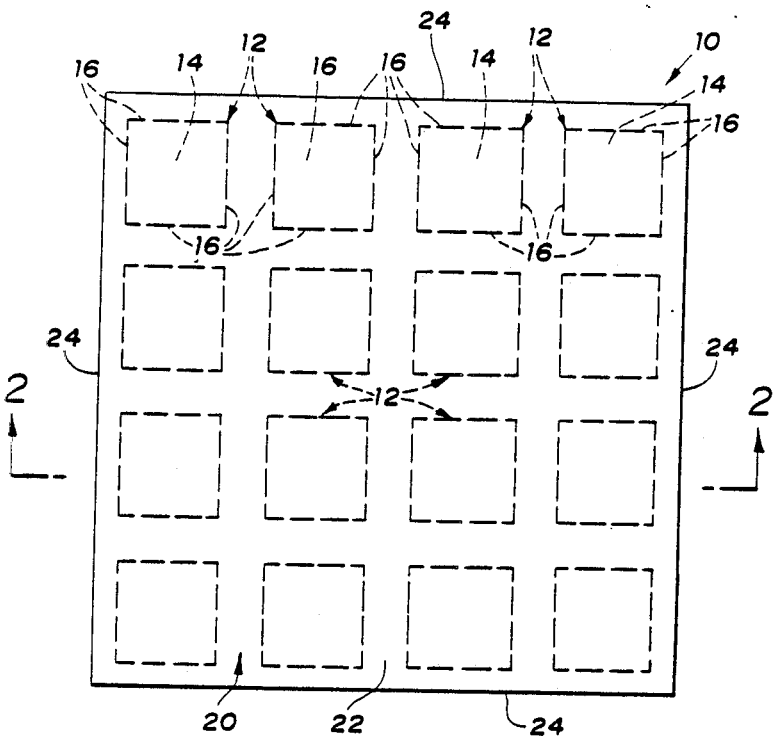
FIG. 1 is a plan view of composite ceramic armor constructed in accordance with the present invention.
Figure 2:
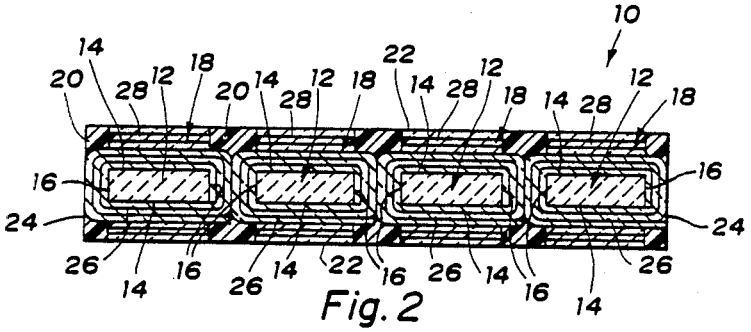
FIG. 2 is a cross sectional view of the composite ceramic armor taken along the direction of line 2—2 in FIG. 1.

As illustrated in FIGS. 1 and 2, composite ceramic armor constructed in accordance with the present invention is generally indicated by 10 and includes a plurality of plate-shaped ceramic tiles 12 each of which has oppositely facing surfaces 14 and a plurality of sides 16. Cloth 18 best illustrated in FIG. 2 is wrapped around each tile 12 over each surface 14 and side 16 of the tile. A synthetic resin matrix 20 permeates the cloth 18 to encapsulate the tiles 12 as is hereinafter more fully described. This resin matrix 20 defines oppositely facing surfaces 22 and a plurality of sides 24. The wrapped cloth 18 spaces the tiles 12 from each other and from the surfaces 22 and sides 24 of the resin matrix 20.

The ceramic tiles 12 of the composite ceramic armor 10 illustrated in FIGS. 1 and 2 are spaced from each other sufficiently far so that shock generated by an impacting projectile will not propagate from one tile to the next while still being sufficiently close to each other so that the projectile to be defeated cannot penetrate between the tiles.

As illustrated in FIG. 1, the ceramic tiles 12 are preferably rectangular and are disclosed as having a square construction that facilitates fabrication of the composite armor with a square construction for incorporation into larger panels. Depending upon the panel shape needed, elongated rectangular tiles can also be used for fabrication into larger panels. Such larger panels provide larger surfaces that can be easily repaired by replacement of a panel having one or more tiles that fracture upon stopping a projectile.

Figure 3:
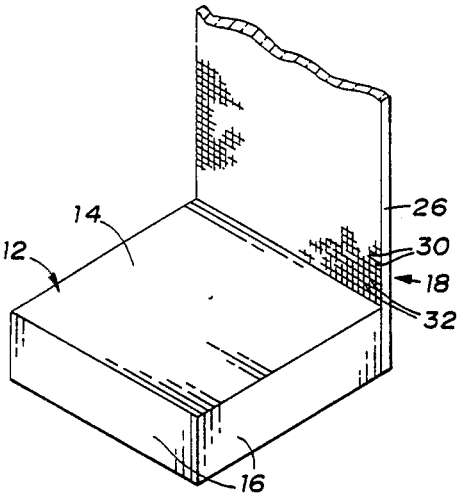
FIG. 3 is a perspective view of a ceramic tile illustrating the manner in which a first cloth strip is wrapped around the rectangular construction of the tile which is preferably square.
Figure 4:
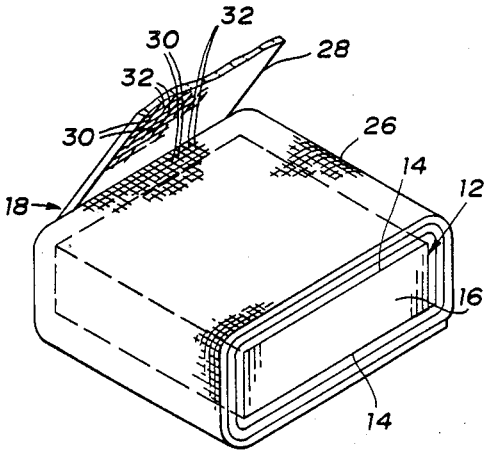
FIG. 4 is a perspective view that illustrates the manner in which a second cloth strip is wrapped around the tile in a direction perpendicular to the first cloth strip.
Figure 5:
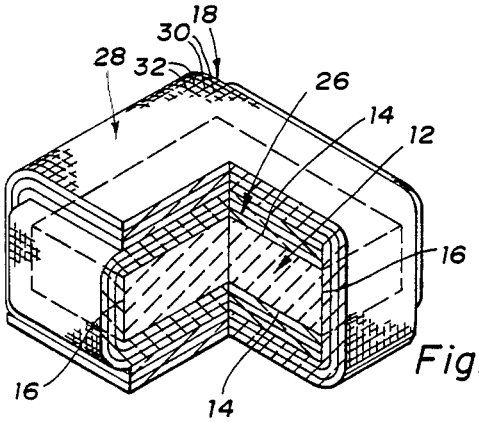
FIG. 5 is a cut-away perspective view of the tile after complete wrapping thereof by both the first and second cloth strips in perpendicular directions to each other.

As illustrated in FIGS. 3, 4 and 5, the cloth 18 preferably includes a pair of cloth strips 26 and 28 wrapped around each tile in perpendicular directions to each other. More specifically, the first cloth strip 26 is wrapped around the ceramic tile 12 as illustrated in FIG. 3 in a first direction add, as shown in FIG. 4, is wrapped a plurality of times to provide the desired spacing which is provided by three turns in the specific embodiment illustrated. The second cloth strip 28 is wrapped around the first cloth strip 26 in a perpendicular direction thereto as shown in FIGS. 4 and 5. This second cloth strip 28 is also wrapped a plurality of times to provide the required spacing which, in the illustrated embodiment, is three turns. Both cloth strips 26 and 28 have a width equal to the length of the sides 16 of the tile 12 such that the wrapped tile is completely covered without using any unnecessary cloth. Such wrapping can also be done with elongated rectangular shapes with cloth strips of different widths each to the side lengths of the elongated rectangular tile.

As illustrated in FIGS. 3, 4 and 5, the cloth 18 is preferably woven and includes perpendicular rovings 30 and 32 which can be made from various materials but are most preferably made from glass fibers so as to be economical while still having the ability to maintain integrity for most types of synthetic resins utilized for the matrix 20. Plastic fibers can also be used, preferably fibers of polyamide plastic such as Kevlar fibers.

It is preferable to utilize a thermosetting synthetic resin for the matrix 20 such as a polyester or epoxy so that the armor will maintain structural integrity even when heated. Also, while a single layer of the cloth wrapped ceramic tiles 12 is disclosed, it is also possible to use two or more layers of the tiles with the spacing between the tiles either aligned or staggered.

Figure 6:
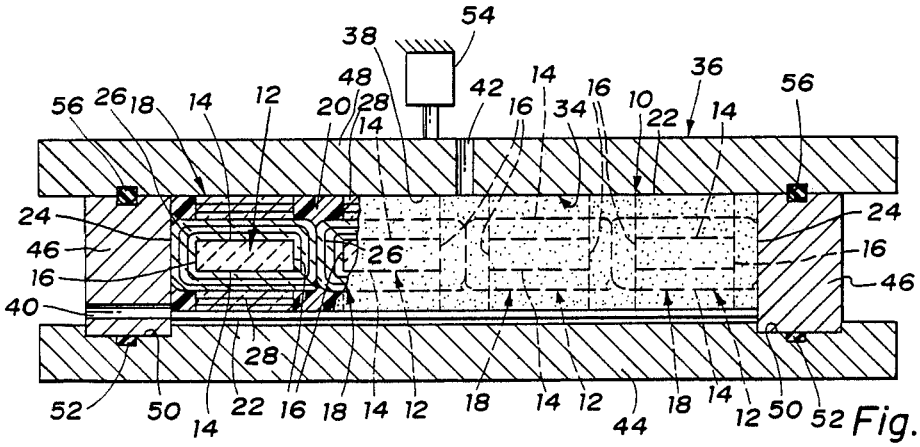
FIG. 6 is a partial sectional view taken through a mold and the ceramic armor which is fabricated within the mold.

The method for making the composite ceramic armor 10 illustrated in FIGS. 1 and 2 is performed by first wrapping the plate-shaped ceramic tiles 12 previously described with the cloth 18 that extends over each surface 14 and side 16 of the tile. These wrapped tiles are then placed as illustrated in FIG. 6 in a mold cavity 34 of a mold 36 such that the wrapped cloth 18 spaces the tiles from each other and from a mold wall 38 that defines the cavity 34. A liquid synthetic resin is then introduced through an inlet 40 of the mold 34 to permeate the wrapped cloth 18 prior to hardening that provides the matrix 20 which encapsulates the tiles 12 and defines the oppositely facing surfaces 22 and sides 24 from which the tiles are spaced by the wrapped cloth. A bleed port 42 permits excessive synthetic resin to bleed out of the mold cavity 34.

It should be noted that the mold 36 illustrated has a lower plate 44, side plates 46 and a top plate 48. the lower plate 44 has recesses 50 that receive the lower ends of the side plates 46, and these recesses 50 also have seal recesses for receiving seals 52 that are most preferably constructed as double-sided foam tape for securing the side plates in position within the recesses 50. The top plate 48 is removable to permit the introduction of the wrapped ceramic tiles into the mold cavity and to also permit removal of the molded composite ceramic armor 10. A suitable schematically illustrated clamp 54 is utilized to hold the top plate 48 in position with a peripheral seal 56 extending along the upper end of the side plates 46 within recesses therein and within a recess in the top plate in order to provide a sealed relationship.

The method for manufacturing the composite ceramic armor most preferably utilizes rectangular tiles that are each wrapped by cloth including two strips that extend perpendicular to each other around the tile as previously described. Square tiles, as also previously mentioned, may be utilized to produce square composite ceramic armor that is easily constructed into larger panels. Elongated rectangular tiles can also be used.

It should be noted that the tiles can be wrapped with cloth by either a manual operation or an automated machine operation.

Woven cloth is also preferably utilized in the method to wrap the tiles as previously described and is advantageously made from woven glass fibers as was also earlier mentioned. Woven plastic fibers can also be used, preferably polyamide plastic fibers such as Kevlar fibers.

While the best mode for practicing the invention has ben described in detail, those familiar with the art to which this invention relates will recognize various alternative ways of practicing the invention as defined by the following claims.

What is claimed is:

1. Composite ceramic armor comprising:

a plurality of plate-shaped ceramic tiles each of which has oppositely facing surfaces and a plurality of sides;

cloth wrapped around each tile over each surface and side thereof; and a synthetic resin matrix permeating the cloth to encapsulate the tiles, said resin matrix defining oppositely facing surfaces and a plurality of sides, and said wrapped cloth spacing the tiles from each other and from the surfaces and sides of the resin matrix.

2. Composite ceramic armor as in claim 1 wherein the cloth is woven.

3. Composite ceramic armor as in claim 2 wherein the woven cloth includes fibers selected from the group consisting of glass fibers and polyamide plastic fibers.

4. Composite ceramic armor as in claim 1 wherein the tiles are rectangular.

5. Composite ceramic armor as in claim 4 wherein the cloth includes a pair of strips wrapped around each tile in perpendicular directions to each other.

6. Composite ceramic armor as in claim 4 or 5 wherein the rectangular tiles are square.

7. Composite ceramic armor comprising:

a plurality of plate-shaped ceramic tiles of a rectangular construction including oppositely facing surfaces and sides connecting the surfaces;

cloth including a pair of cloth strips wrapped around each tile over each surface and side thereof and extending in perpendicular directions to each other; and a synthetic resin matrix permeating the cloth to encapsulate the tiles, said resin matrix having oppositely facing surfaces and a plurality of sides, and said wrapped cloth strips spacing the tiles from each other and from the surfaces and sides of the resin matrix.

8. Composite ceramic armor comprising:

a plurality of plate-shaped ceramic tiles of a rectangular construction including oppositely facing surfaces and sides connecting the surfaces;

cloth including a pair of cloth strips of woven fibers selected from the group consisting of glass fibers and polyamide plastic fibers, said cloth strips being wrapped around each tile over each surface and side thereof and extending in perpendicular directions to each other; and a synthetic resin matrix permeating the cloth to encapsulate the tiles, said resin matrix defining oppositely facing surfaces and a plurality of sides, and said wrapped cloth strips of woven fibers spacing the tiles from each other and from the surfaces and sides of the resin matrix.

9. A method for making composite ceramic armor comprising:

wrapping plate-shaped ceramic tiles, each of which has oppositely facing surfaces and a plurality of sides, with cloth that extends over each surface and side of each tile;

placing the wrapped tiles in a mold cavity with the wrapped cloth spacing the tiles from each other and from a mold wall defining the cavity; and introducing a synthetic resin into the mold cavity to permeate the cloth and provide a matrix that encapsulates the tiles and defines oppositely facing surfaces and sides from which the tiles are spaced by the wrapped cloth.

10. A method for making composite ceramic armor comprising:

wrapping plate-shaped ceramic tiles, each of which has a rectangular shape including oppositely facing surfaces and a plurality of sides, with two cloth strips that extend perpendicular to each other and cooperatively cover each surface and side of each tile;

placing the wrapped tiles in a mold cavity with the wrapped cloth spacing the tiles from each other and from a mold wall defining the cavity; and introducing a synthetic resin into the mold cavity to permeate the cloth and provide a matrix that encapsulates the tiles and defines oppositely facing surfaces and sides from which the tiles are spaced by the wrapped cloth.

11. A method for making composite ceramic armor comprising:

wrapping plate-shaped ceramic tiles, each of which has a rectangular shape including oppositely facing surfaces and sides connecting the surfaces, with cloth strips associated in pairs with each tile and extending in perpendicular directions to each other over both surfaces and each side of the tile;

placing the wrapped tiles in a mold cavity with the wrapped cloth spacing the tiles from each other and from a old wall defining the cavity; and introducing a synthetic resin into the mold cavity to permeate the cloth and provide a matrix that encapsulates the tiles and defines oppositely facing surfaces and sides from which the tiles are spaced by the wrapped cloth.

* * * * *

UNITED STATES PATENT AND TRADEMARK OFFICE

CERTIFICATE OF CORRECTION

PATENT NO. : 4,911,061

DATED : March 27, 1990

INVENTOR(S) : Allen F. Pivitt

It is certified that error appears in the above-identified patent and that said Letters Patent is hereby corrected as shown below:

Column 1, Line 37
"chat" should be --that--.

Column 1, Line 61
"late-shaped" should be --plate-shaped--.

Column 3, Line 9
"add" should be --and--.

Column 3, Line 56
"the" should be --The--.

Column 6, Line 24, Claim 11
Line 3, Claim 11), "old" should be --mold--.

Signed and Sealed this

First Day of October, 1991

*Attest:*

HARRY F. MANBECK, JR.

*Attesting Officer*

*Commissioner of Patents and Trademarks*